US008151776B2

(12) United States Patent
Hirota

(10) Patent No.: US 8,151,776 B2
(45) Date of Patent: Apr. 10, 2012

(54) BREATHER DEVICE IN ENGINE

(75) Inventor: Kentaro Hirota, Tokyo (JP)

(73) Assignee: Fuji Jukogyo Kabushiki Kaisha, Tokyo (JP)

( * ) Notice: Subject to any disclaimer, the term of this patent is extended or adjusted under 35 U.S.C. 154(b) by 563 days.

(21) Appl. No.: 12/371,075

(22) Filed: Feb. 13, 2009

(65) Prior Publication Data

US 2009/0205618 A1 Aug. 20, 2009

(30) Foreign Application Priority Data

Feb. 15, 2008 (JP) ..... 2008-034661

(51) Int. Cl.
*F02B 25/06* (2006.01)
*F01M 13/00* (2006.01)

(52) U.S. Cl. ..... 123/572; 123/573; 123/41.86

(58) Field of Classification Search ..... 123/41.86, 123/572–574, 195 C, 90.38
See application file for complete search history.

(56) References Cited

U.S. PATENT DOCUMENTS 2,885,027 A * 5/1959 Green ..... 55/326
4,627,406 A * 12/1986 Namiki et al. ..... 123/573
5,090,393 A * 2/1992 Holch ..... 123/574
5,129,371 A * 7/1992 Rosalik, Jr. ..... 123/90.38
6,158,423 A * 12/2000 Haack ..... 123/574
6,290,739 B1 * 9/2001 Gieseke et al. ..... 55/330
6,431,159 B2 * 8/2002 Nishi et al. ..... 123/572
6,758,197 B2 * 7/2004 Korenjak et al. ..... 123/572
7,117,858 B2 * 10/2006 Nonaka et al. ..... 123/572
7,455,057 B2 * 11/2008 Hochmayr et al. ..... 123/572
7,648,543 B2 * 1/2010 Faber et al. ..... 55/416
2006/0060174 A1 * 3/2006 Ashida ..... 123/572

FOREIGN PATENT DOCUMENTS

JP 2005-83310 3/2005

* cited by examiner

*Primary Examiner* — Marguerite McMahon
*Assistant Examiner* — Tea Bajramovic
(74) *Attorney, Agent, or Firm* — Smith, Gambrell & Russell, LLP

(57) ABSTRACT

A blow-by gas introducing passage having a blow-by gas inlet port, an air-cleaner-side breather passage that extends upwardly as branched from the blow-by gas introducing passage so as to communicate with an intake system, and a case-side breather passage that extends downwardly as branched from the blow-by gas introducing passage so as to communicate with an oil chamber are provided to an inner surface of a side cover that is detachably mounted to a timing-gear chamber communicating with a crank chamber. The blow-by gas introducing passage, the air-cleaner-side breather passage, and the case-side breather passage are formed integral with the side cover.

23 Claims, 9 Drawing Sheets

BREATHER DEVICE IN ENGINE

CROSS-REFERENCE TO RELATED APPLICATIONS

The disclosure of Japanese Patent Application No. 2008-034661 filed on Feb. 15, 2008 including the specification, drawings, and abstract is incorporated herein by reference in its entirety.

BACKGROUND OF THE INVENTION

1. Field of the Invention

The present invention relates to a breather device in engines, which separates oil mist from blow-by gas containing oil mist and allows the blow-by gas from which the oil mist is removed to be circulated into intake systems.

2. Description of the Related Art

Generally, in four-cycle engines, blow-by gas leaking into a crank chamber from a combustion chamber by passing through a gap between a cylinder and a piston ring is circulated into an intake system so that the gas can be re-combusted. However, when the blow-by gas leaks into the crank chamber, the gas will contain a mist of lubricating oil, or oil mist, in the crank chamber. The oil mist is unfavorably carried to the intake system together with the blow-by gas, resulting in increased consumption of lubricating oil as well as an adverse effect on the engine performance.

In order to solve these problems, there have been proposed various types of breather devices which separate oil mist from the blow-by gas containing the oil mist in the crank chamber so as to supply the blow-by gas having the oil mist removed therefrom to the intake system.

As an example of such a breather device, a breather device disclosed in JP-A-2005-83310 will be described below with reference to FIG. 13 that is a cross-sectional view showing the essential part thereof and FIG. 14 that is an enlarged sectional view of FIG. 13 viewed from an arrow C.

A breather device 100 includes a case-side breather chamber 103, a cylinder-head-side breather chamber, a case-side breather tube 105, a cylinder-head-side breather tube 106, a collecting section 107, and an air-cleaner-side breather tube 108. The case-side breather chamber 103 is provided so as to communicate with a crankcase 101. The cylinder-head-side breather chamber is provided so as to communicate with a cylinder head cover not shown. The case-side breather tube 105 guides the blow-by gas in the case-side breather chamber 103 toward an unillustrated air cleaner. The cylinder-head-side breather tube 106 guides the blow-by gas in the cylinder-head-side breather chamber toward the air cleaner. The collecting section 107 allows the blow-by gas, which is respectively guided by the case-side breather tube 105 and the cylinder-head-side breather tube 106, to be collected. The air-cleaner-side breather tube 108 guides the blow-by gas that is collected to the collecting section 107 toward the air cleaner.

The case-side breather chamber 103 separates the oil contained in the blow-by gas flowing in from the crankcase 101. A case-side joint pipe 109 is mounted above the case-side breather chamber 103. The case-side breather tube 105 is fitted onto the case-side joint pipe 109, whereby the case-side breather chamber 103 and the case-side breather tube 105 are connected to each other through the case-side joint pipe 109.

When the engine is started, the blow-by gas leaking into the crankcase 101 flows into the case-side breather chamber 103, and then passes through the case-side joint pipe 109 and the case-side breather tube 105 to be guided to the collecting section 107. In this case, the oil mist contained in the blow-by gas is separated in the case-side breather chamber 103.

The blow-by gas flowing into the cylinder head cover flows into the cylinder-head-side breather chamber, and then passes through the cylinder-head-side breather tube 106 to be guided to the collecting section 107. In this case, the oil mist contained in the blow-by gas is separated in the cylinder-head-side breather chamber.

The blow-by gas guided by the case-side breather tube 105 and the cylinder-head-side breather tube 106 is collected at the collecting section 107, and sucked into the air cleaner through the air-cleaner-side breather tube 108. In this case, the collecting section 107 functions as a vapor-liquid separating device of the blow-by gas flowing from the cylinder-head-side breather chamber. The separated oil mist is returned to the crankcase 101 through the case-side breather tube 105 and the case-side breather chamber 103 by the action of gravity. The oil mist adhered onto the inside of the air-cleaner-side breather tube 108 is returned to the crankcase 101 through the collection section 107, the case-side breather tube 105, and the case-side breather chamber 103 by the action of gravity.

According to the JP-A-2005-83310, the collecting section 107 serving as the vapor-liquid separating device is provided separately from the main body of the engine, such as the cylinder head, the cylinder head cover, the crankcase, etc., and coupled to these components with the respective tubes. Accordingly, the number of components is increased, whereby the configuration is complicated, which might lead to a troublesome assembling operation and increased manufacturing cost.

SUMMARY OF THE INVENTION

An object of the present invention accomplished in view of the above-mentioned circumstances is to provide a breather device in an engine that can reduce the number of components, can simplify the configuration, is excellent in assemble workability, and is expected to achieve reduced manufacturing cost.

In order to achieve the aforesaid object, a first aspect of the invention is a breather device in an engine including a cylinder head having a timing-gear chamber that accommodates a driven-side rotator fixed to one end of a rotatably supported camshaft and communicates with a crank chamber, and a side cover that is detachably mounted to a side cover attachment part, which is open to the side portion of the timing-gear chamber oppositely to the side face of the driven-side rotator, the driven-side rotator being rotatable in conjunction with a crankshaft rotatably supported within the crank chamber, the breather device removing oil mist from blow-by gas in the engine and allowing the blow-by gas to be circulated into an intake system. The breather device includes a first breather device that separates oil mist from blow-by gas in the timing-gear chamber, a second breather device that separates and removes oil mist from the blow-by gas from which the oil mist is separated by the first breather device and allows the blow-by gas to be circulated into the intake system. The first breather device includes an oil separator that is attached to the one end of the camshaft so as to be rotated by the camshaft. The second breather device includes a blow-by gas introducing passage having a blow-by gas inlet port open to the inner surface of the side cover and a closed leading end, an air-cleaner-side breather passage that extends upwardly, and has an air-cleaner-side inlet port open to the blow-by gas introducing passage and a discharge port communicating with the intake system, and a case-side breather passage that extends downwardly and has a case-side inlet port open to the blow-by gas introducing passage and a discharge port communicating with an oil chamber. The blow-by gas introducing passage, the air-cleaner-side breather passage, and the case-side breather passage are formed so as to be integral with the side cover.

According to a second aspect of the present invention, in the breather device in an engine according to the first aspect, the first breather device includes the oil separator having a base attached to the one end of the camshaft and a plurality of fins that are spaced apart from each other and project from the peripheral edge of the base in a direction away from the camshaft; and a tubular breather housing that projects into the timing-gear chamber from the inner surface of the side cover so as to be coaxial with the camshaft and is open toward the camshaft.

According to a third aspect of the present invention, in the breather device in an engine according to the first or second aspect, the case-side inlet port is open to the lower surface of the blow-by gas introducing passage at its leading end; the case-side breather passage extends downwardly from the case-side inlet port; the air-cleaner-side inlet port is open to the upper surface of the blow-by gas introducing passage as being offset from the case-side inlet port toward the blow-by gas inlet port; and the air-cleaner-side breather passage extends upwardly from the air-cleaner-side inlet port.

A fourth aspect of the present invention provides a breather device in an engine, in which the breather device removes oil mist contained in blow-by gas flowing into an accommodation chamber and allows the blow-by gas to be circulated into an intake system, the accommodation chamber accommodating a timing transmission mechanism that transmits rotation of a crankshaft of the engine to a camshaft, the breather device including an oil separator being attached to one end of the camshaft so as to rotate in the accommodation chamber due to the rotation of the camshaft, and a side cover that is detachably attached to one side of the accommodation chamber. The side cover includes a breather housing that projects into the accommodation chamber and accommodates at least a part of the oil separator, a blow-by gas introducing passage that is open to the inside of the breather housing in which the leading thereof is closed, an air-cleaner-side breather passage that is open in the blow-by gas introducing passage, extends upwardly, and communicates with the intake system, and a case-side breather passage that is open in the blow-by gas introducing passage, extends downwardly, and communicates with an oil chamber. The breather housing, the blow-by gas introducing passage, the air-cleaner-side breather passage, and the case-side breather passage are formed so as to be integral with the side cover. The oil separator and the breather housing constitute a first breather device that separates oil mist from the blow-by gas in the accommodation chamber, while the blow-by gas introducing passage, the air-cleaner-side breather passage, and the case-side breather passage constitute a second breather device that further separates oil mist from the blow-by gas from which the oil mist is separated by the first breather device.

According to a fifth aspect of the present invention, in the breather device in an engine in the fourth aspect, the air-cleaner-side inlet port of the air-cleaner-side breather passage that is open in the blow-by gas introducing passage is formed on the upper surface of the blow-by gas introducing passage as being offset toward the blow-by gas inlet port of the blow-by gas introducing passage, which is open to the inside of the breather housing, with respect to the case-side breather passage.

According to a sixth aspect of the present invention, in the breather device in an engine in the fourth or the fifth aspect, the case-side inlet port of the case-side breather passage that is open in the blow-by gas introducing passage is formed on the lower surface of the blow-by gas introducing passage at its leading end.

According to a seventh aspect of the present invention, in the breather device in an engine in any one of the first to sixth aspects, the upper surface of the blow-by gas introducing passage between the air-cleaner-side inlet port and the leading end of the blow-by gas introducing passage has a guide surface that is tilted so as to gradually approach the case-side inlet port toward the leading end.

According to an eighth aspect of the present invention, in the breather device in an engine in any one of the first to sixth aspects, a partition wall that projects from the upper surface of the blow-by gas introducing passage into the blow-by gas introducing passage is formed from the leading end of the blow-by gas introducing passage to a position closer to the blow-by gas inlet port than to the blow-by gas inlet port.

According to a ninth aspect of the present invention, in the breather device in an engine in any one of the first to eighth aspects, the air-cleaner-side inlet port is open in the blow-by gas introducing passage as being offset in the diameter direction with respect to the center axis of the blow-by gas introducing passage, and the air-cleaner-side breather passage extends upwardly from the air-cleaner-side inlet port.

A tenth aspect of the present invention provides a breather device in an engine, in which the breather device removes oil mist contained in blow-by gas in the engine body and allows the blow-by gas to be circulated into an intake system, the breather device including a blow-by gas introducing passage having a blow-by gas inlet port open to the inner surface of the engine body and a closed leading end, an air-cleaner-side breather passage that extends upwardly, and has an air-cleaner-side inlet port open to the blow-by gas introducing passage and a discharge port communicating with the intake system, and a case-side breather passage that extends downwardly and has a case-side inlet port open to the blow-by gas introducing passage and a discharge port communicating with an oil chamber.

According to an eleventh aspect of the present invention, in the breather device in an engine in the tenth aspect, the breather device removes oil mist contained in blow-by gas in the engine body and allows the blow-by gas to be circulated into an intake system, the breather device including a blow-by gas introducing passage having a blow-by gas inlet port open to the inner surface of the engine body and a closed leading end, an air-cleaner-side breather passage that is branched and extends upwardly, and has an air-cleaner-side inlet port open to the blow-by gas introducing passage and a discharge port communicating with the intake system, and a case-side breather passage that extends downwardly as branched and has a case-side inlet port open to the blow-by gas introducing passage and a discharge port communicating with an oil chamber.

According to a twelfth aspect of the present invention, in the breather device in an engine in the tenth or the eleventh aspect, the upper surface of the blow-by gas introducing passage between the air-cleaner-side inlet port and the leading end of the blow-by gas introducing passage has a guide surface that is tilted so as to gradually approach the case-side inlet port toward the leading end.

According to a thirteenth aspect of the present invention, in the breather device in an engine in any one of the tenth to twelfth aspects, a partition wall that projects from the upper surface of the blow-by gas introducing passage into the blow-by gas introducing passage is formed along edge of the air-cleaner-side inlet port at the side of the blow-by gas inlet port.

According to a fourteenth aspect of the present invention, in the breather device in an engine in any one of the tenth to thirteenth aspects, the air-cleaner-side inlet port is open in the blow-by gas introducing passage as being offset in the diameter direction with respect to the center axis of the blow-by gas introducing passage, and the air-cleaner-side breather passage extends upwardly from the air-cleaner-side inlet port.

The present invention provides the effects described below.

(1) Since the first breather device and the second breather device are provided, oil mist can efficiently be removed from blow-by gas. Therefore, the first breather device and the second breather device can prevent oil mist from being discharged together with blow-by gas to an intake system, thereby minimizing the consumption of lubricating oil as well as maintaining good engine performance.

(2) The first breather device has a simple and compact structure composed of the oil separator and the breather housing, so that productivity is enhanced. Further, the detachability of the side cover and the detachability of the oil separator from the camshaft allow for easy detachment of the first breather device, whereby the maintenance processes for the first breather device, such as repair and inspection, can be performed smoothly and readily.

(3) The second breather device has a simple and small configuration in which the blow-by gas introducing passage, the air-cleaner-side breather passage, and the case-side breather passage are formed integral with the side cover. Therefore, the number of components is remarkably reduced. Furthermore, the second breather device can be assembled with simple labor, whereby the assemble workability and productivity can be enhanced, and the reduction in the manufacturing cost can be expected.

(4) The air-cleaner-side breather passage and the case-side breather passage extend in the vertical direction respectively from the blow-by gas introducing passage. Therefore, the amount of oil mist flowing into the air cleaner together with the blow-by gas can effectively be reduced.

(5) The air-cleaner-side inlet port is offset from the case-side inlet port toward the blow-by gas inlet port (toward the upstream side). With this configuration, the blow-by gas guided to the leading end of the blow-by gas introducing passage and containing oil mist tends to flow in the case-side inlet port (the side of the crank chamber) that is open to the position closer to the leading end. Accordingly, the amount of the blow-by gas flowing to the side of the air cleaner and containing oil mist can effectively be reduced.

(6) Since the partition wall is formed at the upper surface of the blow-by gas introducing passage, the blow-by gas is guided as being bent downwardly at the upstream side of the air-cleaner-side inlet port by the partition wall and tends to flow in the case-side breather passage that is open to the lower surface of the blow-by gas introducing passage. Accordingly, the amount of the blow-by gas flowing into the air-cleaner-side breather passage and containing oil mist can effectively be reduced.

(7) Since the guide surface is formed at the leading end of the blow-by gas introducing passage, the blow-by gas guided to the leading end can tend to flow in the case-side breather passage. Accordingly, the amount of oil mist contained in the blow-by gas sucked by the air cleaner through the air-cleaner-side breather passage can be reduced.

(8) Since the air-cleaner-side inlet port is formed as being offset in the diameter direction of the blow-by gas introducing passage, the amount of the blow-by gas, which has been guided to the leading end, flowing into the air-cleaner-side breather passage can be suppressed.

DETAILED DESCRIPTION OF THE PREFERRED EMBODIMENTS

Embodiments of the breather device in an engine according to the present invention will be described with reference to the drawings.

(First Embodiment)

A first embodiment will be described with reference to FIGS. 1 to 6.

Figure 1:
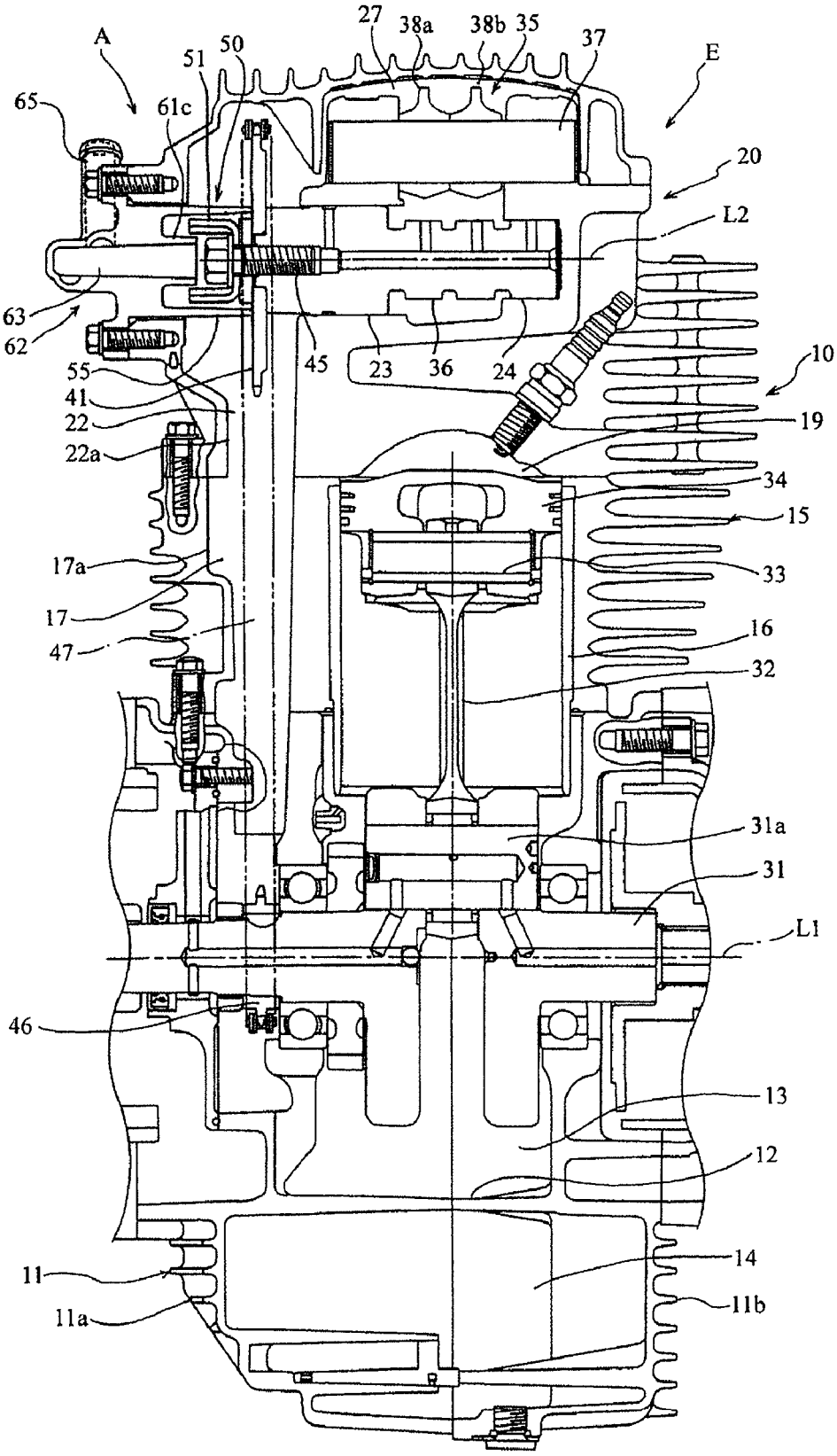
FIG. 1 is a sectional view schematically showing an engine having a breather device according to the first embodiment of the present invention.
Figure 2:
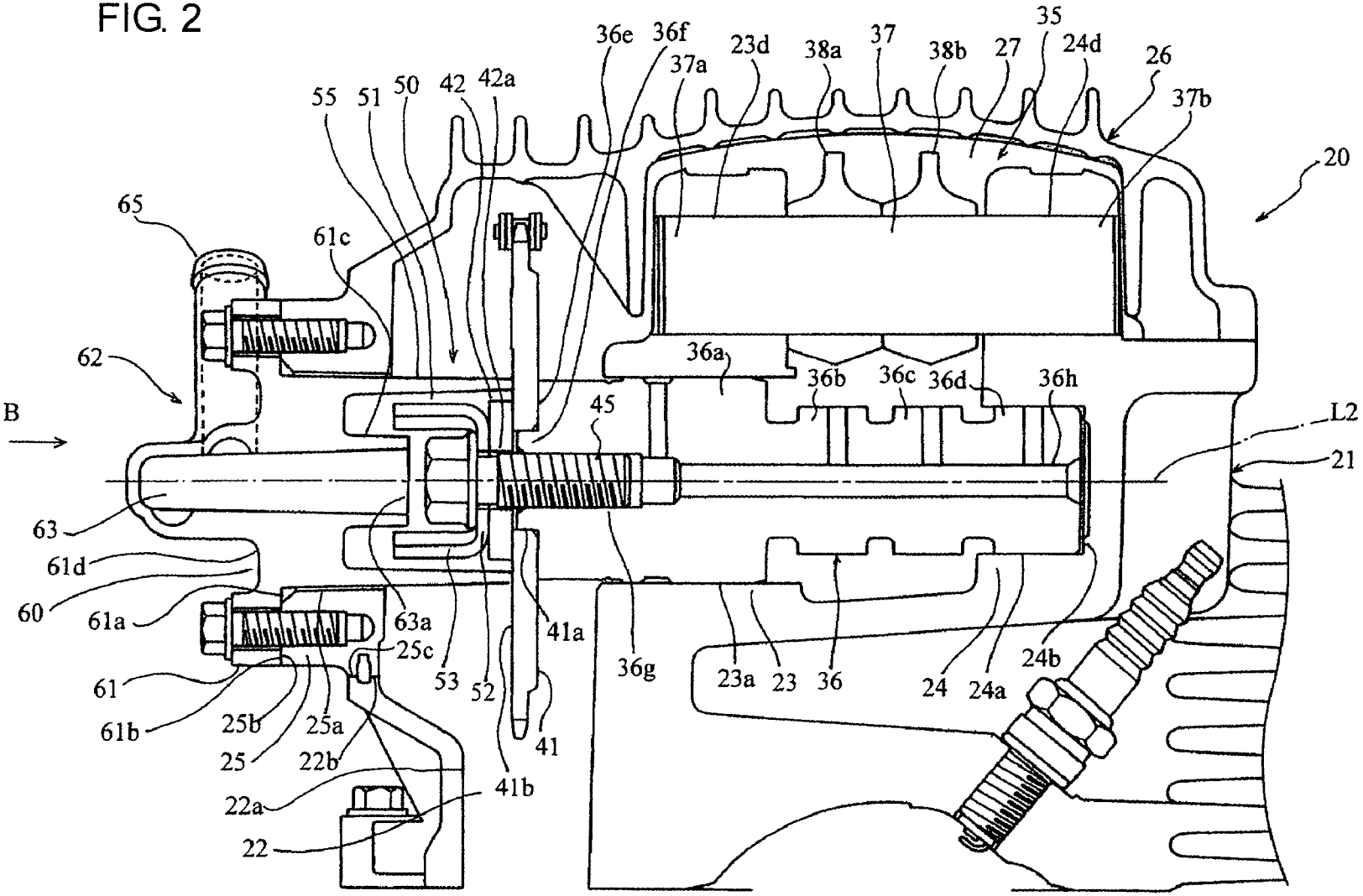
FIG. 2 is an enlarged view of A portion in FIG. 1.
Figure 3:
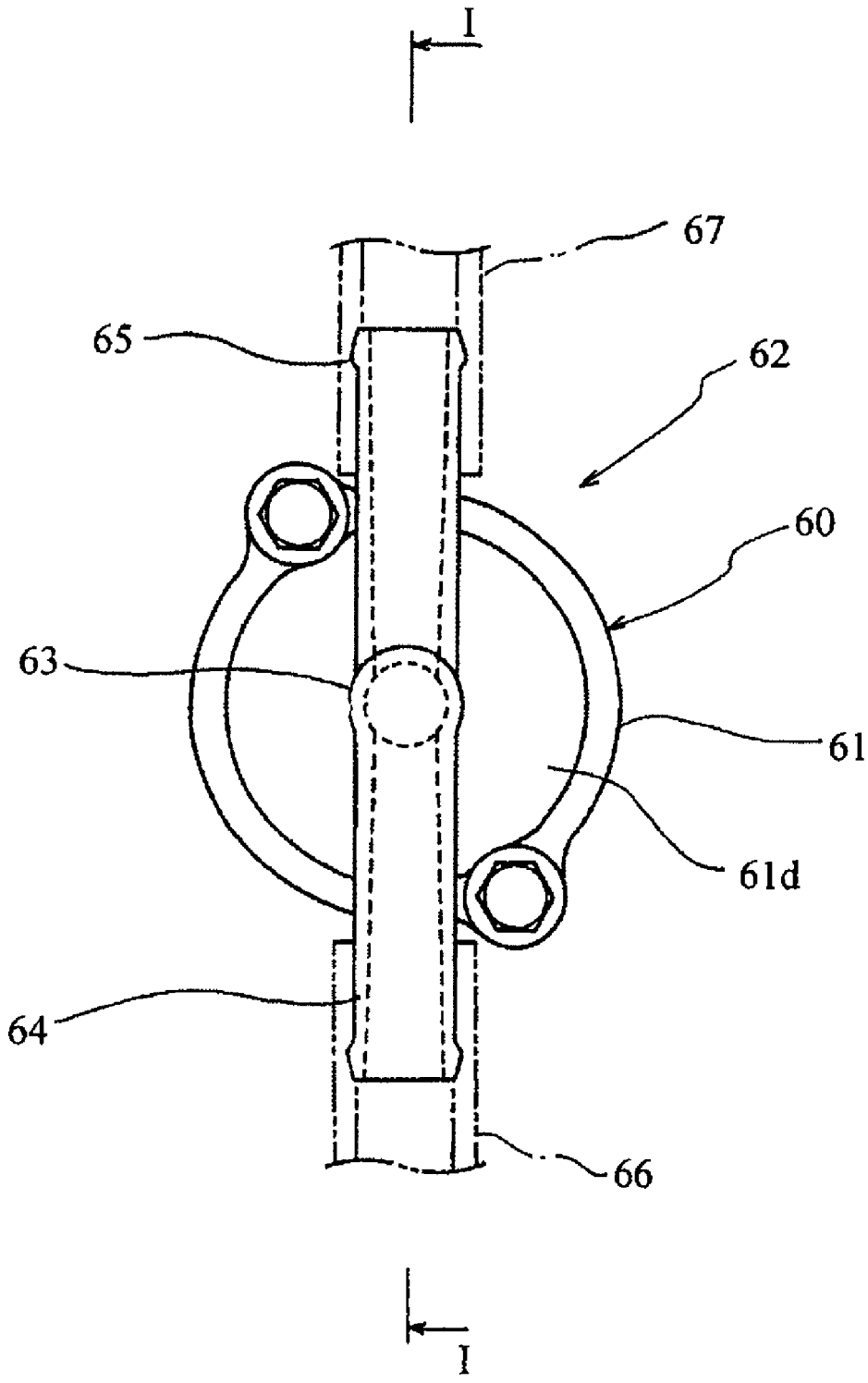
FIG. 3 is a view seen from an arrow B in FIG. 2.
Figure 4:
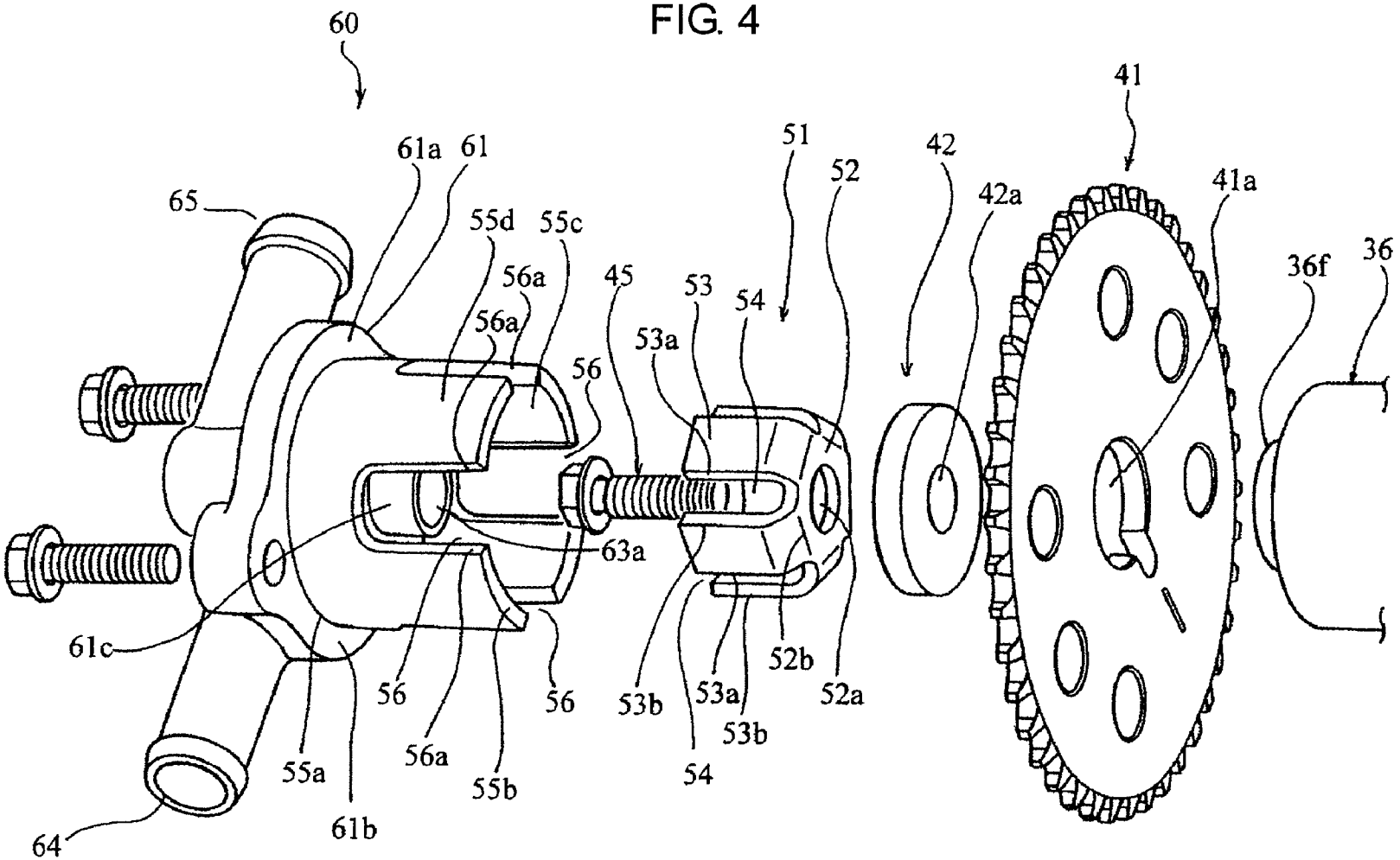
FIG. 4 is an exploded perspective view showing essential parts.

FIG. 1 is a sectional view showing an engine having a breather device according to the present invention, FIG. 2 is an enlarged view of A portion in FIG. 1, FIG. 3 is a view of FIG. 2 viewed from an arrow B, and FIG. 4 is an exploded perspective view of an essential part.

An engine E is a single-cylinder four-cycle OHC engine. Referring to FIG. 1, an engine body 10 of the engine E includes a crankcase 11, a cylinder block 15 joined to the crankcase 11 with a bolt, and a cylinder head 20 joined to the top of the cylinder block 15 with a bolt. The crankcase 11 is formed of a pair of left and right half-bodies 11*a* and 11*b* that are joined together with a bolt.

The crankcase 11 formed of the half-bodies 11*a* and 11*b* has a crank chamber 13 that supports a crankshaft 31 rotatable about an axis line L1 and an oil chamber 14 located below the crank chamber 13. The crank chamber 13 and the oil chamber 14 are divided by a partition wall 12.

The crankshaft 31 has a crankpin 31*a* to which a piston 34 is linked by means of a connecting rod 32 and a piston pin 33. The piston 34 is slidably fitted within a cylinder 16 provided in the cylinder block 15 with a piston ring (not shown) interposed therebetween. The crankshaft 31 is provided with a sprocket 46 that is a drive-side rotator. The cylinder block 15 has a communication path 17 which extends along the cylinder 16 and whose lower end communicates with the crank chamber 13.

The cylinder head 20 has an intake port and an exhaust port that are connected to a combustion chamber 19 and to a carburetor and an exhaust muffler (not shown), respectively. The cylinder head 20 also has an intake valve and an exhaust valve that open and close the respective intake port and exhaust port. Moreover, the cylinder head 20 has disposed therein a valve-operating mechanism 35 for driving the intake valve and the exhaust valve. Specifically, the valve-operating mechanism 35 includes, for example, a camshaft 36, a rocker shaft 37, an exhaust rocker arm 38*a*, and an intake rocker arm 38*b*. The engine E is a so-called inclined engine in which the direction of reciprocation of the piston 34 is inclined with respect to the vertical direction.

Referring to FIGS. 2 and 3, the cylinder head 20 includes a cylinder-head body 21, a rocker cover 26 attached to the cylinder-head body 21 with a mounting bolt, and a side cover 60.

The cylinder-head body 21 has a timing-gear chamber 22 that communicates with the crank chamber 13 through the communication path 17 formed in the cylinder block 15. Furthermore, in order for the camshaft 36 to be fitted in the cylinder-head body 21, the cylinder-head body 21 has a first camshaft hole 23*a* and a second camshaft hole 24*a* having a diameter smaller than that of the first camshaft hole 23*a*. The first camshaft hole 23*a* extends through a first camshaft-support section 23 such that one end of the first camshaft hole 23*a* is open to the timing-gear chamber 22. On the other hand, the second camshaft hole 24*a* extends through a second camshaft-support section 24 and has a cylindrical shape with a closed end defined by a base 24*b*. The camshaft 36 is inserted into these camshaft holes so as to be supported by the cylinder-head body 21, whereby the axis L2 through the rotation center of the camshaft 36 is parallel to the rotation center axis L1 of the crankshaft 31.

The camshaft 36 has a first shaft-engagement portion 36*a* rotatably engaged with the first camshaft hole 23*a*, an exhaust cam 36*b*, an intake cam 36*c*, and a second shaft-engagement portion 36*d* rotatably engaged with the second camshaft hole 24*a*, which are provided in this order along the axis line L2. One end of the camshaft 36 that projects from the first camshaft hole 23*a* towards the timing-gear chamber 22 has a shoulder portion 36*e* from which a sprocket attachment portion 36*f* protrudes on the axis of the camshaft 36. This one end of the camshaft 36 is provided with a threaded hole 36*g* that extends from an end surface of the sprocket attachment portion 36*f*. The camshaft 36 also has an oil hole 36*h* through which lubricating oil from an oil pump can be directly supplied or sprayed to slidable portions such as the first shaft engagement portion 36*a* and the second shaft engagement portion 36*d* or to the other lubricating portions.

The first camshaft-support section 23 and the second camshaft-support section 24 respectively have a first rocker-shaft support hole 23*d* and a second rocker-shaft support hole 24*d* that support respective ends 37*a* and 37*b* of the rocker shaft 37. The rocker shaft 37 axially supports the exhaust rocker arm 38*a* and the intake rocker arm 38*b*. One end of the exhaust rocker arm 38*a* abuts on the top of the exhaust valve, whereas the other end abuts on the exhaust cam 36*b*. Similarly, one end of the intake rocker arm 38*b* abuts on the top of the intake valve, whereas the other end abuts on the intake cam 36*c*. Accordingly, when the exhaust rocker arm 38*a* and the intake rocker arm 38*b* rock in response to rotation of the camshaft 36, the rocker arms 38*a* and 38*b* push the exhaust valve and the intake valve to open the exhaust port and the intake port, respectively.

Referring to FIGS. 1 and 2, the rocker cover 26 is mounted above the cylinder-head body 21 so as to cover the timing-gear chamber 22 from above and from side, and also to cover the rocker shaft 37 from above to form a valve-operating chamber 27.

One side of the rocker cover 26 that covers the timing-gear chamber 22 and that is orthogonal to the camshaft 36 is provided with an annular side-cover attachment part 25. A later-described side cover 60 is detachably mounted to the side cover attachment part 25.

The side cover attachment part 25 has a side cover attachment flange 25*b* that projects from the rocker cover 26 toward the axis L2 and is annularly formed. A breather housing insertion hole 25*a* through which a later-described breather housing 55 is inserted into the timing-gear chamber 22 is formed to the central part of the side cover attachment flange 25*b*. When the rocker cover 26 is mounted to the cylinder-head body 21, the axis L2 of the camshaft 36 and the center axis of the breather housing insertion hole 25*a* agree with each other.

The side cover attachment flange 25*b* is formed so as to project downward from the mounting face of the rocker cover 26 to the cylinder-head body 21. An end face 25*c* that is opposite to the cylinder-head body 21 is formed in the downward projecting portion of the side cover attachment flange 25*b*. On the other hand, a seating portion 22*b* serving as a seating portion of the end face 25*c* is formed to the cylinder-head body.

An oil separator 51 is coaxially aligned with the axis L2 with a mounting bolt 45 at one end of the camshaft 36 projecting into the timing-gear chamber 22 from the first camshaft-support section 23 through a sprocket 41, which serves as a driven-side rotator, and an annular spacer 42, as shown in FIGS. 1 to 4.

The sprocket 41 has a shaft hole 41*a* that is fitted to the sprocket attachment portion 36*f* of the camshaft 36. Moreover, the sprocket 41 has a thickness that is slightly larger than the length of the sprocket attachment portion 36*f*. The spacer 42 has a bolt insertion hole 42*a*, and is formed into a disc-like shape having a diameter larger than the diameter of the shaft hole 41*a* of the sprocket 41.

The oil separator 51 constitutes a first breather device 50 together with the breather housing 55 provided to the later-described side cover 60. Referring to FIGS. 2 and 4, the oil separator 51 has a polygonal plate-like base 52 having a mounting hole 52*a* in the center and having a plurality of linear edges 52*b* around the outer periphery of the base 52. In this embodiment, the base 52 is pentagonal. The oil separator 51 also has flat rectangular fins 53 that are arranged annularly at fixed intervals around the base 52 and are bent substantially perpendicular to the base 52 in a direction away from the camshaft 36 so as to extend from the respective edges 52*b* of the base 52 along the axis line L2. The fins 53 are formed annularly at constant intervals, constituting an annular fin array. Each of these fins 53 is slanted such that a leading edge 53*a* thereof, as viewed in a rotational direction of the camshaft 36, is closer to the axis line L2 than a trailing edge 53*b* thereof is to the axis line L2. In other words, the trailing edge 53*b* is farther from the axis line L2 than the leading edge 53*a* is from the axis line L2. Furthermore, the leading edges 53*a* and the trailing edges 53*b* of the adjacent fins 53 have gaps 54 therebetween that extend in the direction of the axis line L2.

Referring to FIGS. 2 and 4, the joint of the sprocket 41, the spacer 42, and the oil separator 51 to the camshaft 36 will be described below. Firstly, the shaft hole 41*a* of the sprocket 41 is fitted onto the sprocket attachment portion 36*f* of the camshaft 36 in order to mount the sprocket 41 to the camshaft 36. Subsequently, the base 52 of the oil separator 51 is abutted against and positioned on a side surface 41*b* of the sprocket 41 with the spacer 42 interposed therebetween. While the base 52 is in such a positioned state, a mounting bolt 45 is inserted through the mounting hole 52*a* of the oil separator 51 and then through the bolt insertion hole 42*a* of the spacer 42 so as to be bolted into the threaded hole 36*g* of the end portion of the camshaft 36.

The sprocket 41 secured to the camshaft 36 rotates in conjunction with the sprocket 46 on the crankshaft 31 by means of a cam chain 47 extending through the communication path 17 in the cylinder block 15. Consequently, when the crankshaft 31 rotates, the camshaft 36 and the oil separator 51 are rotated through a timing transmission mechanism constituted by the sprocket 46, the cam chain 47, and the sprocket 41. The communication path 17 and the timing-gear chamber 22 communicating with the communication path 17 constitute an accommodation chamber that accommodates the timing transmission mechanism.

Referring to FIGS. 2 and 4, the side cover 60 has a cover body 61 whose rim surface 61*b* abuts on the side cover attachment flange 25*b* so as to cover one side of the timing-gear chamber 22. The side cover 60 is attached to the rocker cover 26 with mounting bolts.

A base end 55*a* is attached to the inner surface 61*a* of the cover body 61. The breather housing 55 having a cylindrical shape and provided with an inner peripheral surface 55*c* and an outer peripheral surface 55*d* projecting along the axis line L2. The breather housing 55 has an inner diameter that is larger than the diameter of the oil separator 51, and covers the oil separator 51 in a rotatable manner. The breather housing 55 is disposed with a gap between the outer periphery surface 55*d* thereof and the inner periphery surface 25*a* of the side-cover attachment part 25. Furthermore, the breather housing 55 has a tip end 55*b* that faces and abuts the side surface 41*b* of the sprocket 41 so as to restrict the movement of the camshaft 36 in the axial direction thereof, whereby the camshaft 36 can be maintained at a predetermined position.

The breather housing 55 has a plurality of substantially U-shaped openings 56 that are open at the side of the tip end 55*b* and are arranged along the circumference of the breather housing 55. Specifically, each substantially U-shaped opening 56 is defined by opposite side edges 56*a* that extend along the axis line L2. In this embodiment, the breather housing 55 is given four openings 56 arranged annularly at equal intervals.

Figure 5:
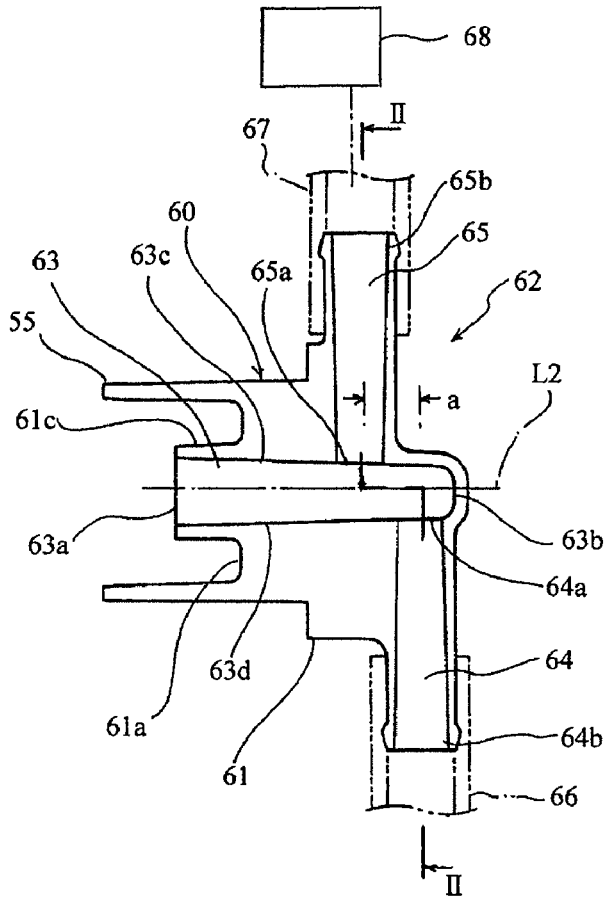
FIG. 5 is a sectional view taken along a line I-I in FIG. 3.
Figure 6:
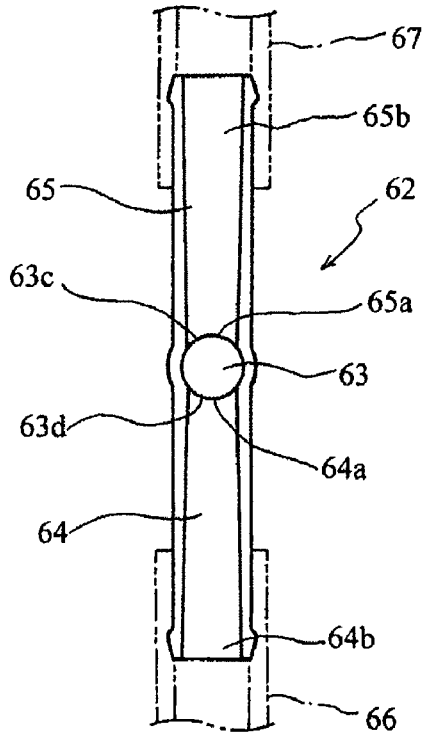
FIG. 6 is a sectional view taken along a line II-II in FIG. 5.

A second breather device 62 is formed integral with the side cover 60. The breather device 62 will be described below with reference to FIG. 2 and FIGS. 4 to 6. FIG. 5 is a sectional view taken along a line I-I in FIG. 3, and FIG. 6 is a sectional view taken along a line II-II in FIG. 5.

The second breather device 62 includes a blow-by gas introducing passage 63, a case-side breather passage 64, and an air-cleaner-side breather channel 65. The blow-by gas introducing passage 63 is formed to the inner surface 61*a* of the cover body 61 so as to be coaxial with the axis line L2. The blow-by gas introducing passage 63 has a blow-by gas inlet port 63*a* that is open in the oil separator. The blow-by gas introducing passage 63 extends outwardly from the blow-by gas inlet port 63*a*, and its leading end 63*b* is closed. In the present embodiment, the blow-by gas introducing passage 63 extends parallel to the axis line L2. A case-side inlet port 64*a* is open to the lower surface 63*b* of the blow-by gas introducing passage 63 at the side of the leading end 63*b*. The case-side breather passage 64 extends downward from the case-side inlet port 64*a*. An air-cleaner-side inlet port 65*a* is open to the upper surface 63*c* of the blow-by gas introducing passage 63. The air-cleaner-side breather passage 65 extends upward from the air-cleaner-side inlet port 65*a*. The air-cleaner-side inlet port 64*a* is positioned to the side of the blow-by gas inlet port 63*a* (to the upstream side) from the case-side inlet port 64*a* by a predetermined offset amount. Notably, the blow-by gas introducing passage 63 at the side of the blow-by gas inlet port 63*a* projects from the inner surface 61*a* of the cover body 61.

A discharge port 64*b* of the case-side breather passage 64 projecting from the cover body 61 communicates with the crank chamber 13 through a case-side breather tube 66. On the other hand, a discharge port 65*b* of the air-cleaner-side breather passage 65 projecting from the cover body 61 communicates with the intake system through an air-cleaner-side breather tube 67. In the present embodiment, the discharge port 65*b* of the air-cleaner-side breather passage 65 communicates with the air cleaner 68.

The blow-by gas containing oil mist, which cannot be separated by the first breather device, flows into the blow-by gas introducing passage 63 from the blow-by gas inlet port 63*a* that is open to the timing-gear chamber 22. This blow-by gas is guided to the leading end 63*b* of the blow-by gas introducing passage 63. The blow-by gas, which is guided to the leading end 63*b* and contains oil mist, is liable to flow in the air-cleaner-side inlet port 65*a* and the case-side inlet port 64*a* open to the blow-by gas introducing passage 63.

The blow-by gas flowing into the case-side inlet port 64*a* is guided to the crank chamber. On the other hand, the oil mist contained in the blow-by gas flowing into the air-cleaner-side inlet port 65*a* is separated by its own weight during when it flows upwardly along the air-cleaner-side breather passage 65. The blow-by gas from which the oil mist is separated is sucked into the air cleaner 68. The separated oil mist is dropped on the inner surface of the air-cleaner-side breather passage 65 to be returned into the blow-by gas introducing passage 63. This oil mist flows into the case-side inlet port 64*a* open to the lower surface 63*d* of the blow-by gas introducing passage 63 by its own weight. Thereafter, the oil mist flows into the crank chamber 13 through the case-side breather tube 66. The air-cleaner-side breather passage 65 extends upwardly and the case-side breather passage 64 extends downwardly from the blow-by gas introducing passage 63, whereby the amount of the oil mist flowing into the air cleaner 68 together with the blow-by gas can effectively be reduced.

In the present embodiment, the air-cleaner-side inlet port 65*a* is mounted so as to be offset toward the side of the blow-by gas inlet port 63*a* (toward the upstream side) from the case-side inlet port 64*a*. With this configuration, the blow-by gas, which is guided to the leading end 63*a* and contains the oil mist, tends to flow in the case-side inlet port 64*a* (the side of the crank chamber 13) that is open to the position closer to the leading end 63*b*. Accordingly, the amount of the blow-by gas, which flows in the air-cleaner 68 and contains the oil mist, can effectively be reduced. Notably, the case-side inlet port 64*a* is desirably formed to the lower surface 63*d* as closer to the leading end 63*b* as possible in order to allow the blow-by gas guided to the leading end 63*b* to tend to flow into the case-side inlet port 64*a*.

In the present embodiment, the blow-by gas introducing passage 63 extends parallel to the axis line L2 from the blow-by gas inlet port 63*a*. However, the invention is not limited thereto. The blow-by gas introducing passage 63 can extend upwardly or downwardly.

The lubrication in the engine E will be described below. Specifically, the unillustrated oil pump that is driven when the engine E is operated supplies the lubricating oil in the oil chamber 14 to the respective lubrication sections in the crank chamber 13 and to lubrication sections in the valve-operating mechanism 35 or the like disposed within the cylinder head 20. The lubricating oil that has been used for lubricating the lubrication sections is collected in the crank chamber 13. For example, the lubricating oil used for lubricating the valve-operating mechanism 35 becomes in a state of mist or oil mist, and travels along the wall 22*a* of the timing-gear chamber 22 and the wall 17*a* of the communication path 17 as droplets so as to be collected in the crank chamber 13. The lubricating oil collected in the crank chamber 13 is returned to the oil chamber 14 through a valve hole (not shown) located in the partition wall 12. Specifically, this valve hole opens and closes in accordance with differential pressure between the crank chamber 13 and the oil chamber 14 that occurs due to pressure fluctuation in the crank chamber 13.

The operation of the engine E provided with the first breather device 50 and the second breather device 62 will now be described.

When the engine E is in operation, blow-by gas leaks from the combustion chamber 19 to flow into the crank chamber 13 by passing through a gap between the cylinder 16 in the cylinder block 15 and the piston 34 or the piston ring. The crank chamber 13 contains oil mist scattered from the rotating crankshaft 31, oil mist to be used for lubricating the lubrication sections, and oil mist that has been collected after being used for lubricating the lubrication sections.

Likewise, in the valve-operating chamber 27, oil mist is scattered from the rotating camshaft 36 or the like. The oil mist in the valve-operating chamber 27 flows into the timing-gear chamber 22 from the valve-operating chamber 27 and travels along the wall 22*a* of the timing-gear chamber 22 and the wall 17*a* of the communication path 17 as droplets so as to be collected in the crank chamber 13. When the sprocket 46 and the sprocket 41 provided on the camshaft 36 rotate upon rotation of the crankshaft 31, the lubricating oil adhered to the sprockets 41 and 46 and the cam chain 47 is scattered within the communication path 17 and the timing-gear chamber 22.

Therefore, blow-by gas that has passed through the crank chamber 13, the communication path 17 and the timing-gear chamber 22, which include scattered oil mist, contains a large amount of oil mist.

The blow-by gas containing the oil mist flows into the breather housing 55, which constitutes the first breather device 50, through the openings 56 via the communication path 17 and the timing-gear chamber 22, due to the pressure fluctuation. The blow-by gas flowing into the breather housing 55 through the openings 56 comes into contact with the fins 53 of the rotating oil separator 51. In this case, the oil mist contained in the blow-by gas adheres to the fins 53 due to the viscosity of the oil mist itself, and thus is separated from the blow-by gas. The blow-by gas from which the oil mist is removed by the oil separator 51 flows into the interior of the oil separator 51 by passing through the gaps 54 of the oil separator 51.

On the other hand, the oil mist adhered to the fins 53 of the oil separator 51 is scattered radially due to the centrifugal force generated by the rotating oil separator 51. The scattered oil mist is received by the inner periphery surface 55*c* of the breather housing 55 and drips to the inner periphery surface 25*a* of the side-cover attachment part 25 through the openings 56 of the breather housing 55. The oil mist then travels along the wall 22*a* of the timing-gear chamber 22 and along the wall 17*a* of the communication path 17 in the cylinder block 15 as droplets so as to be collected in the crank chamber 13.

Swirl is applied to the blow-by gas, from which the oil mist is removed and which flows in the interior of the oil separator 51, by the rotation of the oil separator 51. The swirl of the blow-by gas causes the blow-by gas having a small specific gravity to be retained at the central portion of the separator 51, i.e., in the vicinity of the axis line L2 in the separator 51. On the other hand, the oil mist remaining in the blow-by gas has a relatively large specific gravity, so that it flows outwardly by the centrifugal force to be adhered onto the inner surfaces 53*e* of the fins 53. Accordingly, the oil mist is separated from the blow-by gas.

The blow-by gas near the center of the oil separator 51, which has only an extremely small amount of oil mist remaining therein, flows in the blow-by gas introducing passage 63 of the second breather device 62, which is provided integral with the side cover 60 and to which the blow-by gas inlet port 63*a* is open on the axis coaxial with the axis line L2. The blow-by gas is then guided to the leading end 63*b* of the blow-by gas introducing passage 63.

In this case, the blow-by gas tends to flow in the case-side breather passage 64 that is open to the position closer to the leading end 63*b* so as to be guided to the crank chamber 14. The blow-by gas can flow in the air-cleaner-side breather passage 65, which is open as being offset toward the upstream side from the case-side breather passage 64, due to the negative pressure in the air cleaner 68. The oil mist having a relatively large specific gravity is separated from the blow-by gas by its own weight during when the blow-by gas passes through the air-cleaner-side breather passage 65. The separated oil mist drops along the inner surface of the air-cleaner-side breather passage 65 to be returned into the blow-by gas introducing passage 63. Then, the returned oil mist further flows in the case-side breather passage 64, which is open to the blow-by gas introducing passage 63, by its own weight so as to be returned to the crank chamber 14. Thus, the oil mist supplied to the air cleaner 68 together with the blow-by gas is suppressed, whereby the blow-by gas from which the oil mist is well removed can be supplied to the intake system.

According to the first embodiment, the first breather device 50 has a simple configuration that can be formed by attaching the oil separator 51 having the fins 53 into the breather housing 55. With this first breather device 50, the oil mist can be effectively removed from the blow-by gas. The second breather device 62 is provided in addition to the first breather device 50. Accordingly, the breather device 50 and the second breather device 62 can prevent oil mist from being discharged together with blow-by gas to an intake system, thereby minimizing the consumption of lubricating oil as well as maintaining good engine performance.

In addition, since the oil separator 51 is mounted on the camshaft 36 and the breather housing 55 is provided on the side cover 60, the breather device 50 can be made compact and can allow for higher productivity. Furthermore, the detachability of the side cover and the detachability of the oil separator 51 from the camshaft 36 allow for easy detachment of the first breather device 50, whereby the maintenance processes for the first breather device 50, such as repair and inspection, can be performed smoothly and readily.

Furthermore, the second breather device 62 has a simple configuration in which the blow-by gas introducing passage 63, the air-cleaner-side breather passage 65 branched upwardly from the blow-by gas introducing passage 63, and the case-side breather passage 64 branched downwardly from the blow-by gas introducing passage 63 are formed integral with the side cover 60. Therefore, the number of components is remarkably reduced. Furthermore, the detachability of the side cover 60 allows for easy detachment of the second breather device 62. Consequently, the second breather device 62 can be assembled with simple labor, whereby the assemble workability can be enhanced, and the reduction in the manufacturing cost can be expected.

(Second Embodiment)

The second embodiment of the present invention will be described with reference to FIGS. 7 and 8. The configuration of the second breather device 62 mounted to the side cover 60 in the present embodiment is different from that in the first embodiment. The second breather device 62 will mainly be described. In the second embodiment, the components, members, and portions that are the same as those in the engine described in the first embodiment are given the same reference characters or numerals, and detailed descriptions thereof will not be repeated.

Figure 7:
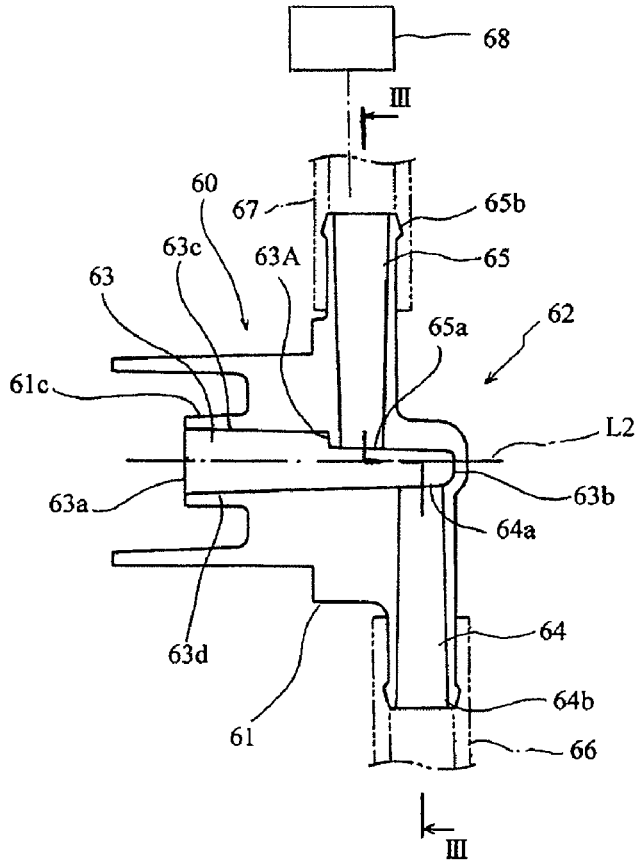
FIG. 7 is a sectional view schematically showing a side cover according to the second embodiment.
Figure 8:
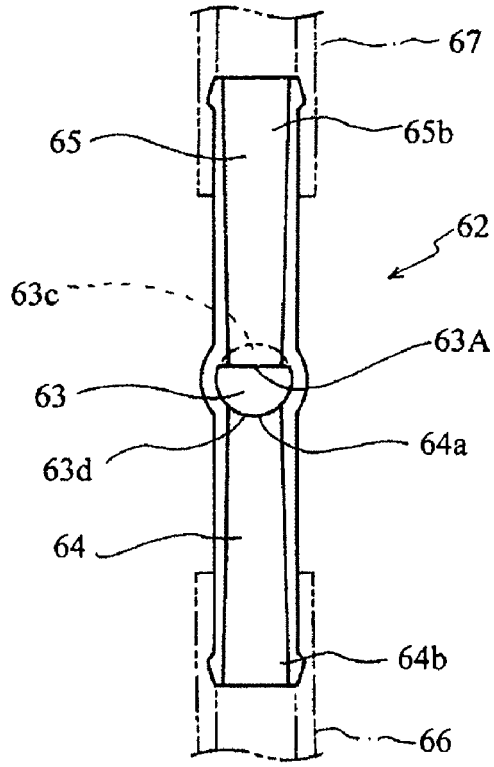
FIG. 8 is a sectional view taken along a line III-III in FIG. 7.

FIG. 7 is a sectional view, corresponding to FIG. 5, showing the side cover 60, and FIG. 8 is a sectional view taken along a line III-III in FIG. 7.

In the second embodiment, a partition wall 63A, which projects into the blow-by gas introducing passage 63 from the upper surface of the blow-by gas introducing passage 63 like a weir, is formed to the air-cleaner-side breather passage 65 along the edge of the air-clean-side inlet port 65*a* at the side of the blow-by-gas inlet port 63*a*. The partition wall 63A extends from the leading end 63*b* to the position closer to the blow-by gas inlet port 63*a* than to the air-cleaner-side inlet port 65*a*.

In the second embodiment, the blow-by gas introduced from the blow-by gas inlet port 63*a*, which is open to the timing-gear chamber 22, into the blow-by gas introducing passage 63 is guided toward the leading end 63*b* of the blow-by gas introducing passage 63. In this case, the blow-by gas is guided as being bent downwardly at the upstream side of the air-cleaner-side inlet port 65*a* by the partition wall 63A, so that it tends to flow in through the case-side inlet port 64*a* formed to the lower surface 63*d* of the blow-by gas introducing passage 63. Therefore, the amount of the blow-by gas, which flows in the air-cleaner-side breather passage 65 and contains oil mist, can effectively be reduced. Consequently, compared to the first embodiment, the breather device 50 and the second breather device 62 can further prevent oil mist from being discharged together with blow-by gas to an intake system, thereby minimizing the consumption of lubricating oil as well as maintaining good engine performance.

(Third Embodiment)

The third embodiment of the present invention will be described with reference to FIGS. 9 and 10. The configuration of the second breather device 62 mounted to the side cover 60 in the present embodiment is different from that in the first embodiment. The second breather device 62 will mainly be described. In the third embodiment, the components, members, and portions that are the same as those in the engine described in the first embodiment are given the same reference characters or numerals, and detailed descriptions thereof will not be repeated.

Figure 9:
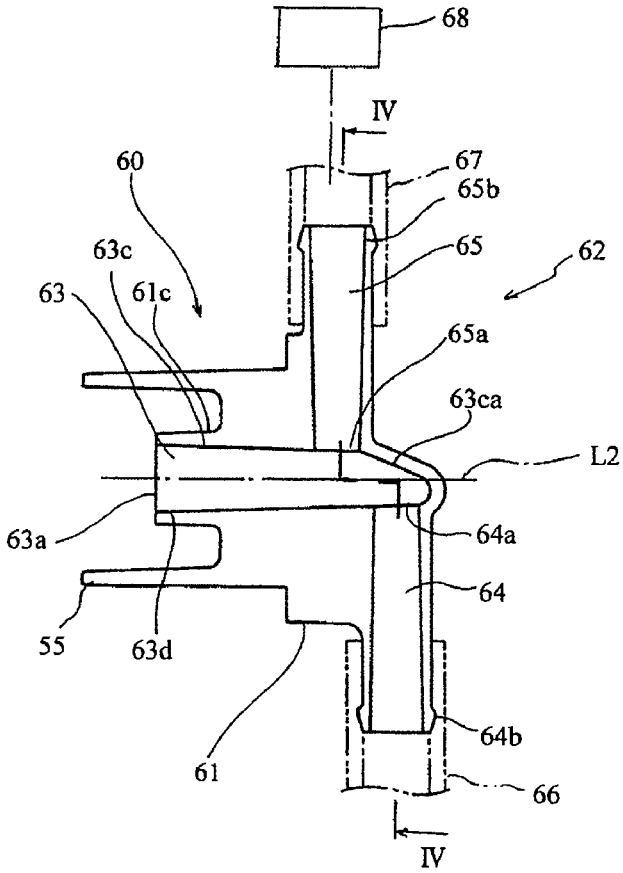
FIG. 9 is a sectional view schematically showing a side cover according to the third embodiment.
Figure 10:
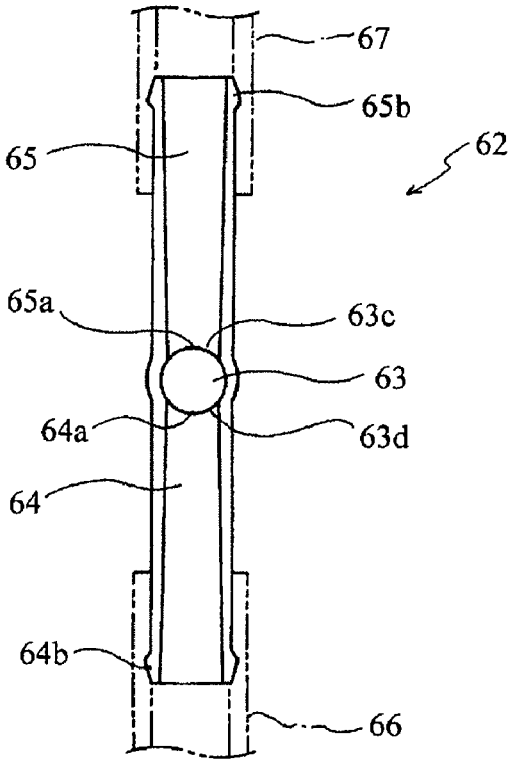
FIG. 10 is a sectional view taken along a line IV-IV in FIG. 9.

FIG. 9 is a sectional view, corresponding to FIG. 5, showing the side cover 60, and FIG. 10 is a sectional view taken along a line IV-IV in FIG. 9.

A guide surface 63*ca* is formed within the range from the edge of the air-cleaner-side inlet port 65*a* at the side of the leading end 63*b* to the leading end 63*b* of the blow-by gas introducing passage 63. The guide surface 63*ca* is an inclined surface that gradually approaches (tilts with respect to the axis line L2) the lower surface 63*d*, i.e., the case-side inlet port 64*a* from the air-cleaner-side inlet port 65*a* (upstream side) toward the leading end 63*b* (downstream side).

The second breather device 62 allows the blow-by gas guided to the leading end 63*b* to tend to flow in the case-side breather passage 64 by the guide surface 63*ca*. Thus, the amount of oil mist contained in the blow-by gas that is sucked by the air cleaner 68 through the air-cleaner-side breather passage 65 can be reduced. Compared to the first embodiment, the breather device 50 and the second breather device 62 can further prevent oil mist from being discharged together with blow-by gas to an intake system, thereby minimizing the consumption of lubricating oil as well as maintaining good engine performance.

(Fourth Embodiment)

The fourth embodiment of the present invention will be described with reference to FIGS. 11 and 12. The configuration of the second breather device 62 mounted to the side cover 60 in the present embodiment is different from that in the first embodiment. The second breather device 62 will mainly be described. In the third embodiment, the components, members, and portions that are the same as those in the engine described in the first embodiment are given the same reference characters or numerals, and detailed descriptions thereof will not be repeated.

Figure 11:
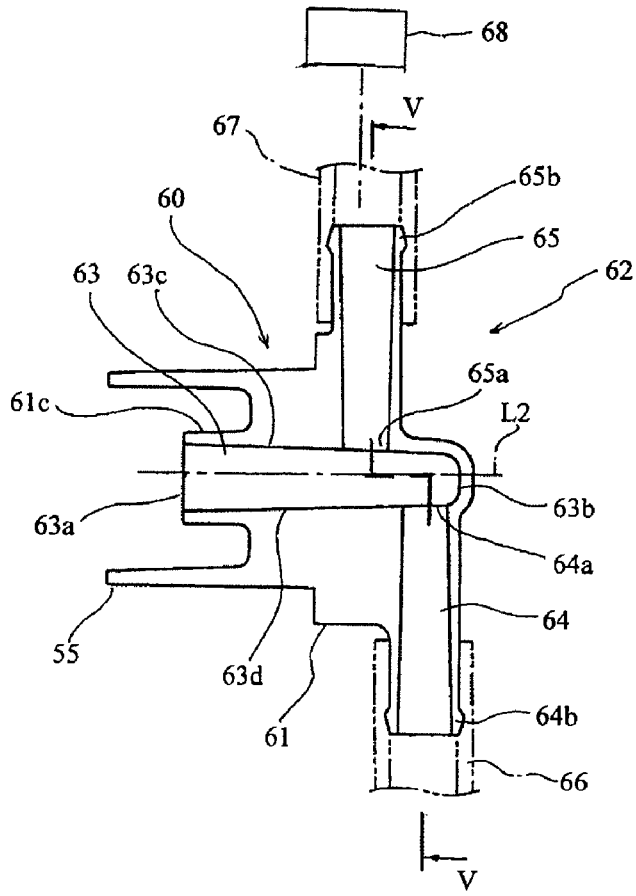
FIG. 11 is a sectional view schematically showing a side cover according to the fourth embodiment.
Figure 12:
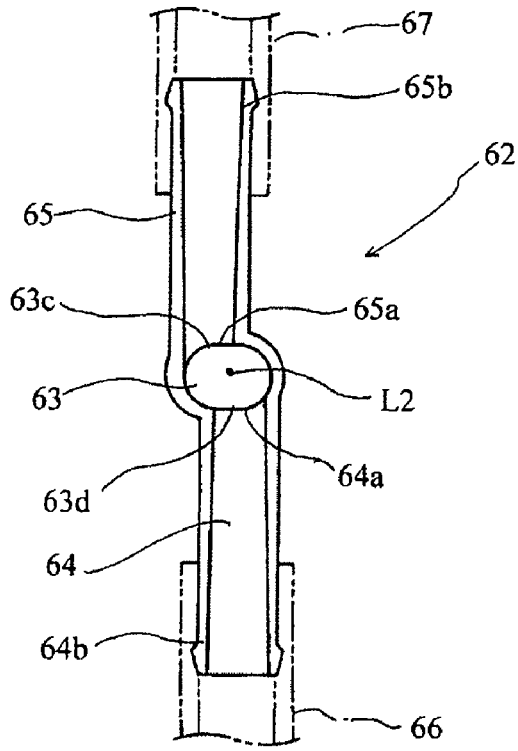
FIG. 12 is a sectional view taken along a line V-V in FIG. 11.
Figure 13:
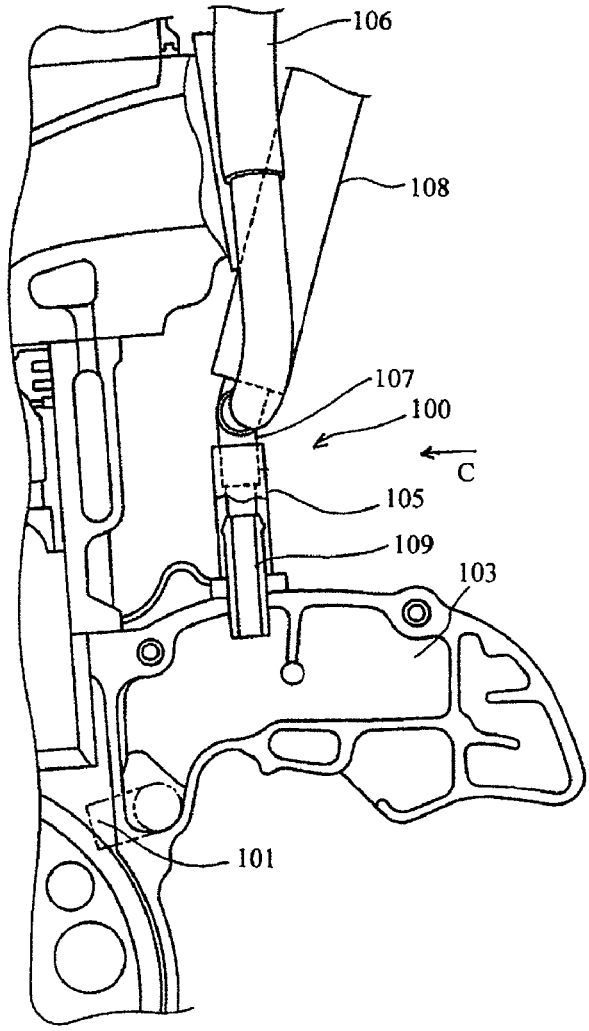
FIG. 13 is a sectional view schematically showing an engine having a conventional breather device.
Figure 14:
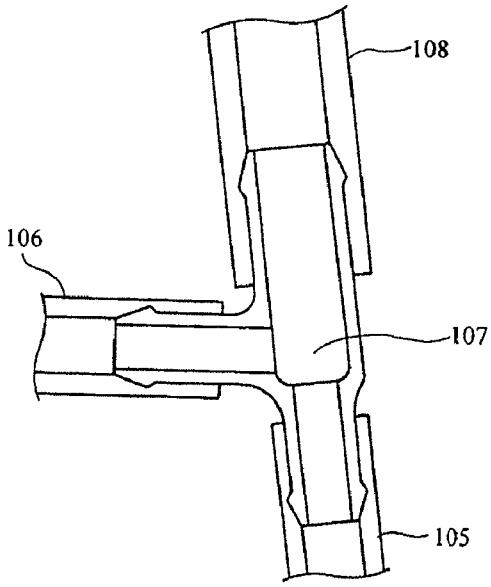
FIG. 14 is an enlarged sectional view seen from an arrow C in FIG. 13.

FIG. 11 is a sectional view, corresponding to FIG. 5, showing the side cover 60, and FIG. 12 is a sectional view taken along a line V-V in FIG. 11.

The air-cleaner-side inlet port 65*a* of the air-cleaner-side breather passage 65 is formed as being offset in the diameter direction of the blow-by gas introducing passage 63 with respect to the axis line L2.

Since the air-cleaner-side inlet port 65*a* is open as being offset in the diameter direction of the blow-by gas introducing passage 63, the amount of the blow-by gas, which is guided to the leading end 63*b* and flows in the air-cleaner-side breather passage 65, can be suppressed in the second breather device 62. Thus, compared to the first embodiment, the breather device 50 and the second breather device 62 can further prevent oil mist from being discharged together with blow-by gas to an intake system, thereby minimizing the consumption of lubricating oil as well as maintaining good engine performance.

The technical scope of the present invention is not limited to the above embodiments, and modifications are permissible without departing from the scope of the invention. For example, the air-cleaner-side inlet port 65*a* in the second and third embodiments can be formed as being offset in the diameter direction of the blow-by gas introducing passage 63 with respect to the axis line L2, like the air-cleaner-side breather passage 65 in the fourth embodiment. Further, the guide surface 63*ca* in the third embodiment can be formed in the second embodiment.

In the above-mentioned embodiments, the case-side inlet port 64*a* and the air-cleaner-side inlet port 65*a* in the second breather device 62 are open to the blow-by gas introducing passage 63 as being offset in the direction of the axis line L2. However, the case-side inlet port 64*a* and the air-cleaner-side inlet port 65*a* can be open to the blow-by gas introducing passage 63 without being offset in the direction of the axis line L2.

Moreover, in the aforesaid embodiments, the second breather device 62 is mounted so as to be integral with the side cover 60. However, the breather device, which is composed of the blow-by gas introducing passage having the inner surface formed with the blow-by gas inlet port and the leading end closed, the air-cleaner-side breather passage, the case-side breather passage or other components, can be mounted so as to be integral with not only the side cover but also the engine body such as the cylinder block, cylinder head, rocker cover, or the like.

What is claimed is:

1. A breather apparatus in an engine including a cylinder head having a timing-gear chamber that accommodates a driven-side rotator fixed to one end of a rotatably supported camshaft and communicates with a crank chamber, and a side cover that is detachably mounted to a side cover attachment part, which is open to the side portion of the timing-gear chamber oppositely to a side face of the driven-side rotator, the driven-side rotator being rotatable in conjunction with a crankshaft rotatably supported within the crank chamber, the breather apparatus removing oil mist from blow-by gas in the engine and allowing the blow-by gas to be circulated into an intake system, the breather apparatus comprising:

a first breather device that separates oil mist from blow-by gas in the timing-gear chamber; and a second breather device that separates and removes oil mist from blow-by gas received from the first breather device, wherein the first breather device includes:

an oil separator that is attached to the one end of the camshaft so as to be rotated by the camshaft, the second breather device includes:

a blow-by gas introducing passage having a blow-by gas inlet port open to the inner surface of the side cover and a closed leading end;

an air-cleaner-side breather passage that extends upwardly, and has an air-cleaner-side inlet port open to the blow-by gas introducing passage and a discharge port communicating with the intake system; and a case-side breather passage that extends downwardly and has a case-side inlet port open to the blow-by gas introducing passage and a discharge port communicating with an oil chamber, wherein the blow-by gas introducing passage, the air-cleaner-side breather passage, and the case-side breather passage are formed so as to be integral with the side cover, and the oil separator of the first breather device extends about a periphery of the blow-by gas inlet port of the second breather device.

2. The breather apparatus according to claim 1, wherein the first breather device includes:

the oil separator having a base attached to the one end of the camshaft and a plurality of fins that are spaced apart from each other and project from the peripheral edge of the base in a direction away from the camshaft; and a breather housing having a tubular portion that projects into the timing-gear chamber from the inner surface of the side cover so as to be coaxial with the camshaft and is open toward the camshaft.

3. The breather apparatus according to claim 1, wherein the case-side inlet port is open to the lower surface of the blow-by gas introducing passage at the leading end of the blow-by gas introducing passage;

the case-side breather passage extends downwardly from the case-side inlet port;

the air-cleaner-side inlet port is open to the upper surface of the blow-by gas introducing passage at a location offset from the case-side inlet port in a direction toward the blow-by gas inlet port; and the air-cleaner-side breather passage extends upwardly from the air-cleaner-side inlet port.

4. A breather apparatus in an engine, in which the breather apparatus removes oil mist contained in blow-by gas flowing into an accommodation chamber and allows the blow-by gas to be circulated into an intake system, the accommodation chamber accommodating a timing transmission mechanism that transmits rotation of a crankshaft of the engine to a camshaft, the breather apparatus including:

an oil separator being attached to one end of the camshaft so as to rotate in the accommodation chamber due to the rotation of the camshaft; and a side cover that is detachably attached to one side of the accommodation chamber, wherein the side cover includes:

a breather housing that projects into the accommodation chamber and accommodates at least a part of the oil separator;

a blow-by gas introducing passage that is open to the inside of the breather housing in which the leading end thereof is closed;

an air-cleaner-side breather passage that is open in the blow-by gas introducing passage, extends upwardly, and communicates with the intake system; and a case-side breather passage that is open in the blow-by gas introducing passage, extends downwardly, and communicates with an oil chamber, wherein the breather housing, the blow-by gas introducing passage, the air-cleaner-side breather passage, and the case-side breather passage are formed so as to be integral with the side cover, the oil separator and the breather housing constitute a first breather device that separates oil mist from the blow-by gas in the accommodation chamber, the blow-by gas introducing passage, the air-cleaner-side breather passage, and the case-side breather passage constitute a second breather device that further separates oil mist from blow-by gas received from the first breather device, and the oil separator of the first breather device extends about a periphery of a blow-by gas inlet port of the blow-by gas introducing passage of the second breather device.

5. The breather apparatus according to claim 4, wherein the blow-by gas introducing passage comprises a blow-by gas inlet port which is open to the inside of the breather housing; and an air-cleaner-side inlet port of the air-cleaner-side breather passage is formed to be open on an upper surface of the blow-by gas introducing passage at a location offset in a direction toward the blow-by gas inlet port relative to the location of a case-side inlet port of the case-side breather passage.

6. The breather apparatus according to claim 4, wherein a case-side inlet port of the case-side breather passage is formed to be open on a lower surface of the blow-by gas introducing passage, at the leading end of the blow-by gas introducing passage.

7. The breather apparatus according to claim 1, wherein the upper surface of the blow-by gas introducing passage between the air-cleaner-side inlet port and the leading end of the blow-by gas introducing passage has a guide surface that is tilted so as to gradually approach the case-side inlet port toward the leading end.

8. The breather apparatus according to claim 1, wherein a partition wall that projects from the upper surface of the blow-by gas introducing passage into the blow-by gas introducing passage extends from the leading end of the blow-by gas introducing passage to a position that is closer to the blow-by gas inlet port than to the air-cleaner-side inlet port.

9. The breather apparatus according to claim 1, wherein the air-cleaner-side inlet port is open in the blow-by gas introducing passage such that the center axis of the air-cleaner-side inlet port is offset from the center axis of the blow-by gas introducing passage, and the air-cleaner-side breather passage extends upwardly from the air-cleaner-side inlet port.

10. A breather device in an engine, in which the breather device removes oil mist contained in blow-by gas in the engine body and allows the blow-by gas to be circulated into an intake system, the breather device including:

a blow-by gas introducing passage having a blow-by gas inlet port open to the inner surface of the engine body and a closed leading end;

an air-cleaner-side breather passage that extends upwardly from the blow-by gas introducing passage, and has an air-cleaner-side inlet port open to the blow-by gas introducing passage and a discharge port communicating with the intake system; and a case-side breather passage that extends downwardly from the blow-by gas introducing passage, and has a case-side inlet port open to the blow-by gas introducing passage and a discharge port communicating with an oil chamber, wherein the blow-by gas introducing passage, the air-cleaner-side breather passage, and the case-side breather passage are formed so as to be integral with the side cover, and the air-cleaner-side inlet port is open to an upper surface of the blow-by gas introducing passage at a location offset from the case-side inlet port in a direction toward the blow-by gas inlet port.

11. The breather device according to claim 10, wherein the case-side inlet port is open to the lower surface of the blow-by gas introducing passage at the leading end of the blow-by gas introducing passage;

the case-side breather passage extends downwardly from the case-side inlet port; and the air-cleaner-side breather passage extends upwardly from the air-cleaner-side inlet port.

12. The breather device according to claim 10, wherein the upper surface of the blow-by gas introducing passage between the air-cleaner-side inlet port and the leading end of the blow-by gas introducing passage has a guide surface that is tilted so as to gradually approach the case-side inlet port toward the leading end.

13. The breather device according to claim 10, wherein a partition wall that projects from the upper surface of the blow-by gas introducing passage into the blow-by gas introducing passage is formed along the edge of the air-cleaner-side inlet port at the side of the blow-by gas inlet port.

14. The breather device according to claim 10, wherein the air-cleaner-side inlet port is open in the blow-by gas introducing passage such that the center axis of the air-cleaner-side inlet port is offset from the center axis of the blow-by gas introducing passage, and the air-cleaner-side breather passage extends upwardly from the air-cleaner-side inlet port.

15. The breather apparatus according to claim 4, wherein the upper surface of the blow-by gas introducing passage between the air-cleaner-side inlet port and the leading end of the blow-by gas introducing passage has a guide surface that is tilted so as to gradually approach the case-side inlet port toward the leading end.

16. The breather apparatus according to claim 4, wherein a partition wall that projects from the upper surface of the blow-by gas introducing passage into the blow-by gas introducing passage extends from the leading end of the blow-by gas introducing passage to a position that is closer to the blow-by gas inlet port than to the air-cleaner-side inlet port.

17. The breather apparatus according to claim 4, wherein the air-cleaner-side inlet port is open in the blow-by gas introducing passage such that the center axis of the air-cleaner-side inlet port is offset from the center axis of the blow-by gas introducing passage, and the air-cleaner-side breather passage extends upwardly from the air-cleaner-side inlet port.

18. The breather apparatus according to claim 1, wherein a breather housing projects from a surface opposing an open end of the oil separator of the first breather device, and extends about a periphery of the oil separator.

19. The breather apparatus according to claim 4, wherein the breather housing projects from a surface opposing an open end of the oil separator of the first breather device, and extends about a periphery of the oil separator.

20. The breather device according to claim 10, wherein the case-side inlet port is open to a lower surface of the blow-by gas introducing passage; and the air-cleaner-side inlet port is open to an upper surface of the blow-by gas introducing passage at a location sufficiently offset from the case-side inlet port such that, when viewed from a vertical perspective, the air-cleaner-side inlet port does not overlap with the case-side inlet port.

21. The breather apparatus according to claim 1, wherein the blow-by gas introducing passage, the air-cleaner-side breather passage, and the case-side breather passage are monolithically formed with the side cover.

22. The breather apparatus according to claim 4, wherein the breather housing, the blow-by gas introducing passage, the air-cleaner-side breather passage, and the case-side breather passage are monolithically formed with the side cover.

23. The breather device according to claim 10, wherein the blow-by gas introducing passage, the air-cleaner-side breather passage, and the case-side breather passage are monolithically formed with the side cover.

* * * * *